United States Patent [19]

Kadle

[11] Patent Number: 4,901,791

[45] Date of Patent: Feb. 20, 1990

[54] CONDENSER HAVING PLURAL UNEQUAL FLOW PATHS

[75] Inventor: Durgaprasad S. Kadle, Getzville, N.Y.

[73] Assignee: General Motors Corporation, Detroit, Mich.

[21] Appl. No.: 223,984

[22] Filed: Jul. 25, 1988

[51] Int. Cl.[4] ..... F28F 1/10

[52] U.S. Cl. ..... 165/150; 165/173

[58] Field of Search ..... 165/150, 173

[56] References Cited

U.S. PATENT DOCUMENTS

| | | | |
|---|---|---|---|
| 2,068,955 | 1/1937 | Kritzer et al. | 165/150 |
| 2,792,201 | 5/1957 | Whistler | 165/150 X |
| 3,346,043 | 10/1967 | Thurnauer | 165/172 X |
| 4,344,482 | 8/1982 | Dietzsch | 165/150 X |
| 4,446,915 | 5/1984 | Welch | 165/150 X |

*Primary Examiner*—Robert G. Nilson

*Attorney, Agent, or Firm*—R. L. Phillips

[57] ABSTRACT

A refrigeration condenser has at least two serpentine paths of unequal lengths (effected by unequal numbers of loops in the paths) extending between common inlet and outlet ports. By adding this design capability to the conventional equal path length condensers greater design flexibility is provided to permit smaller incremental size changes from conventional equal path length condensers, and allows inlet and outlet ports to be on the same side or on opposite sides without any change in condenser size or performance.

3 Claims, 3 Drawing Sheets

CONDENSER HAVING PLURAL UNEQUAL FLOW PATHS

FIELD OF THE INVENTION

This invention relates to condensers and particularly to condensers having parallel flow passages.

Refrigeration systems require a condenser to remove heat from the refrigerant. In general, a given system requires a minimum heat transfer capacity and thus a minimum condenser size, however greater operating efficiency is obtained by a condenser size larger than the minimum size. Thus optimal design requires some latitude in the size constraints imposed by a certain application.

In automotive air conditioning systems the vehicle design is a source of size constraints for the condenser. The condenser is typically mounted in the front of the vehicle just in front of the radiator and in front of the engine. Various vehicle structures tend to intrude into the required condenser space and limit the available condenser size. It can be important to make efficient use of all the available area.

One of the considerations affecting condenser size is the physical placement of the system components and the routing of working fluid from the condenser to the other components. This may call for both inlet and outlet ports of the condenser to be on one side or to be on opposite sides. The fluid passages loop back and forth from one side to the other an even number of times (or passes) for ports on the same side or an odd number of times for ports on opposite sides of the condenser.

Another size constraint is imposed by practical manufacturing considerations. A manufacturer of condensers or other heat exchangers has equipment designed to produce condenser elements of a particular size and the various heat exchangers produced by that manufacturer are comprised of a number of those elements combined to yield the desired characteristics. For example, tubes of width x and spaced by a distance y are interconnected with end couplers and have intervening fins or air centers of width y to make up a core assembly having a serpentine tubular passage from an inlet to an outlet. Such a design with a single passage and a given port arrangement can be increased or decreased in vertical height by an amount 2 (x+y) or a multiple thereof by changing the number of loops. Since x and y may be on the order of 0.2 and 0.7 inch, respectively, the incremental change 2 (x+y) is about 1.8 inch.

A preferred condenser design has an inlet and an outlet connected by two parallel tubular passages. An example of a prior art version of this design is shown in FIG. 1 wherein the tubular passages comprise a series of straight horizontal tubes coupled by U-shaped bends which are separate elements, although not shown as separate in the schematic drawings. An inlet port 10 is coupled by a Y-shaped connector 12 to two series of tubes 14 and 16 (of width x) which meander as a pair of passages A and B through the several loops of the condenser core 18 and terminate at another Y-shaped connector 20 which connects to an outlet port 22. Adjacent tubes are spaced by a distance y and an air center 24 or fin of width y is sandwiched between adjacent tubes and between the outer tubes and end plates 26. This dual passage arrangement results in shorter passage lengths than a single path of the same total length with lower pressure drop of the refrigerant across the condenser and enhanced efficiency. With that design a change of the outlet port from the inlet side to the opposite side requires adding or deleting a dual pass for an incremental change of 2(x+y) and an incremental height change for a given port arrangement requires adding or subtracting at least one complete loop of two dual passes or 4(x+y) which is about 3.6 inch. If a space limitation results in a gap of a few inches between the condenser and the surrounding structure, this allows cooling air to bypass the condenser since the air resistance to passing through the core is greater than bypassing the core, and cooling capacity is consequently reduced. A better match of condenser size to the air passage thus increases efficiency by providing a larger heat exchange area and better air flow management through the core.

SUMMARY OF THE INVENTION

It is therefore an object of the invention to provide a multiple passage serpentine condenser providing a greater choice of condenser sizes for a given size of component parts.

The invention is carried out by a condenser for a refrigeration system, the condenser having an inlet and an outlet, comprising; at least two parallel flow passages connecting the inlet to the outlet, each flow passage comprising a serpentine path having a sufficient number of passes across the condenser so that each passage extends from the inlet to the outlet, the flow passages having different numbers of passes thereby having unequal lengths.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE PREFERRED EMBODIMENT

Figure 1:
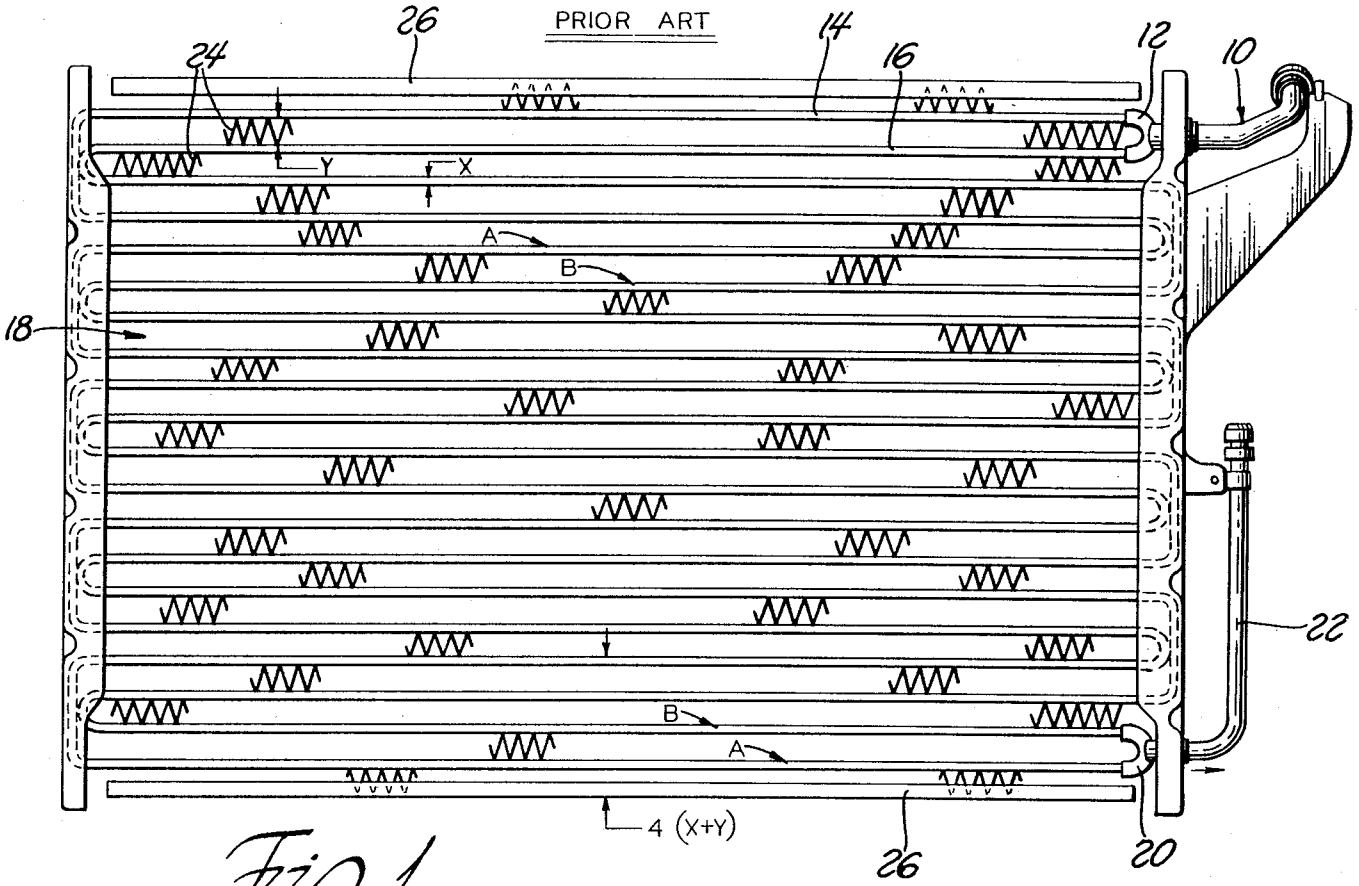
FIG. 1 is an elevational view of a prior art dual passage serpentine condenser.

In general, condenser design has been concerned with proper management of fluid flow and optimizing various pressures in the system, and where the condenser has a dual path the balancing of such flows and pressures has been deemed to be important, and properly so. According to conventional wisdom, surging will result from unequal path lengths and consequently unequal passage lengths must then be avoided. However, it has been discovered and proven experimentally that any surging occurring in the proposed condenser structure is minor and quite acceptable.

While the invention is described in terms of a dual passage condenser, a larger number of passages may be employed within the spirit of the invention. FIG. 2 illustrates how the invention allows the outlet port 22 to be changed from the inlet side to the opposite side of the condenser without any dimensional change. The same structural concept also permits the condenser to be dimensionally changed in smaller increments than is possible using only the conventional design. As in FIG. 1, the tubes 14 and 16 make up two passages A and B, respectively, extending between inlet and outlet Y-shaped connectors 12 and 20, and air centers 24 are included between the adjacent tubes, the whole comprising the core 18.

Figure 2:
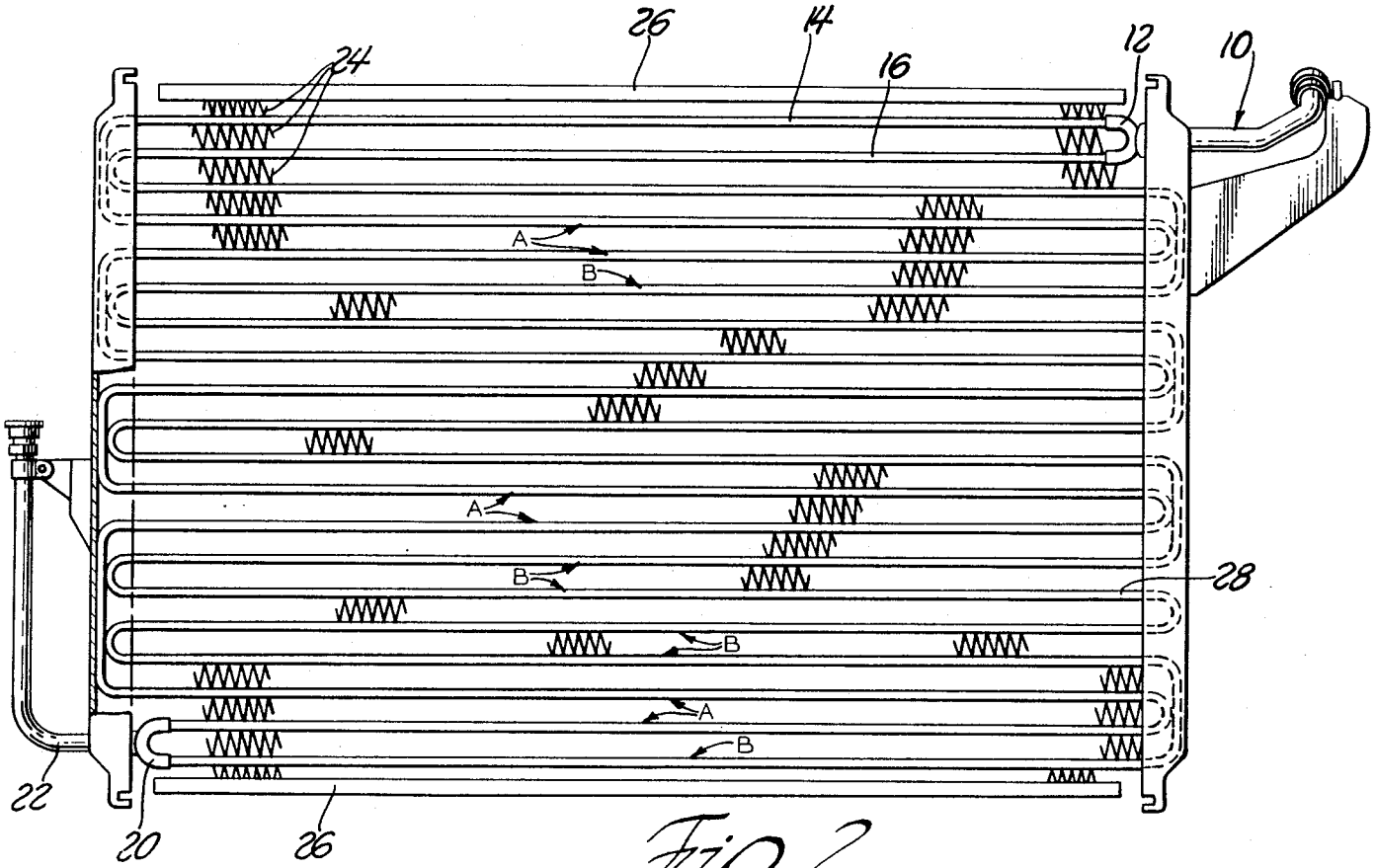
FIG. 2 is a partly broken away elevational view of a first embodiment of a dual passage serpentine condenser according to the invention.

Both FIG. 1 and FIG. 2 examples have 20 tubes and 21 air centers and thus have the same height. In FIG. 1, passages A and B have equal number of tubes. In FIG. 2, there are nine tubes 14 in passage A, and eleven tubes 16 in passage B. Starting from the inlet 10 the passages A and B are arranged side by side and meander together throughout several loops; however somewhere before the outlet an extra loop 28 is added to the B passage at the expense of the A passage. Thus it is possible to change from the FIG. 1 structure with both ports on the same side to the FIG. 2 structure with ports on opposite sides with no change in condenser height.

The FIG. 2 structure can be enlarged by adding another tube to each passage A and B to yield a condenser with ports on the same side, like FIG. 1, so that passage A has ten tubes and passage B has twelve tubes for a total of twelve tubes or two tubes more than FIG. 1. By contrast, the FIG. 1 structure can be enlarged (while maintaining the ports on the same side) only by adding two tubes to each passage for an incremental change of four tubes or twice that afforded by the modified Figure two structure. Thus by making selective use of both structures, condensers can be designed with smaller increments of height without regard for equality of passage length. Tests reveal that the two designs are equally effective in performance.

Figure 3:
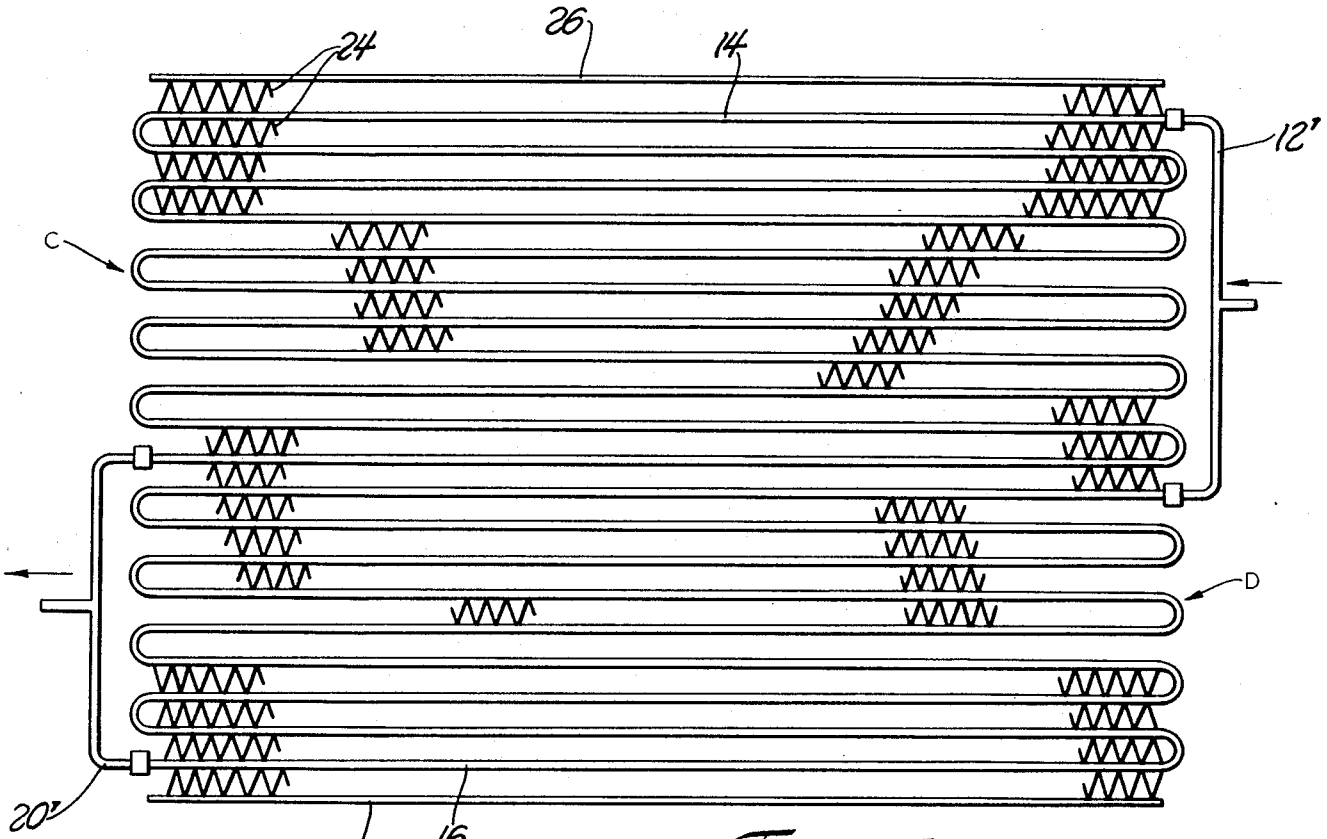
FIG. 3 is a schematic elevational view of a second embodiment of a dual passage serpentine condenser according to the invention.

FIG. 3 shows a variant of the invention using two unequal path lengths with eleven tubes 14 in passage C and nine in passage D. Here each passage covers an exclusive portion of the condenser area. Instead of routing the tubes in pairs, each connector 12' and 20' has a large span which allows each passage C and D to be widely separated at both the inlet and outlet ends. All the principles discussed for FIG. 2 apply here so that equal path lengths and unequal lengths can be used with equivalent performance, and the incremental size changes and the changes of port configuration are the same.

It will thus be seen that the invention provides flexibility of condenser design by adding new routing schemes to the designer's arsenal of desirable condenser structures so that there is a greater choice of sizes to match the available space and moreover there is complete flexibility in port arrangement. The new passage routing and the conventional routing have equal performance and only minimal differences in the amount of surging.

The embodiments of the invention in which an exclusive property or privilege is claimed are defined as follows:

1. A condenser for a refrigeration system, the condenser having an inlet and an outlet, comprising;

at least two parallel flow passages all laying in a common plane and connecting the inlet to the outlet, each flow passage comprising a serpentine path having a sufficient number of passes across the condenser so that each passage extends from the inlet to the outlet, the flow passages having different numbers of passes thereby having unequal lengths.

2. A condenser for a refrigeration system, the condenser having an inlet and an outlet, comprising;

two parallel flow passages laying in a common plane and nesting with each other and connecting the inlet to the outlet, each flow passage comprising a serpentine path meandering across the whole area of the condenser so that each passage extends from the inlet to the outlet, one flow passage having two more passes than the other passage thereby having a greater length than the other passage.

3. A condenser for a refrigeration system, the condenser having an inlet and an outlet, comprising;

two parallel flow passages laying in a common plane and connecting the inlet to the outlet, each flow passage comprising a serpentine path meandering across a portion of the condenser area substantially exclusive of the other passage so that each path extends from the inlet to the outlet, one flow passage having two more passes than the other passage thereby having a greater length and covering a greater portion of the condenser area than the other passage.

* * * * *